United States Patent [19]

Eldridge

[11] 3,951,706

[45] Apr. 20, 1976

[54] SOLID PROPELLANT MIXTURES AND PROCESS OF PREPARATION

[76] Inventor: Judson B. Eldridge, 8055 E. Thomas Apt. A-101, Scottsdale, Ariz. 85251

[22] Filed: July 3, 1962

[21] Appl. No.: 207,440

[52] U.S. Cl. ..... 149/19.8; 149/19.92; 149/38; 149/39; 149/42; 149/76; 149/91; 149/92; 149/93; 149/104; 264/3 R; 149/97; 149/98

[51] Int. Cl.[2] ..... C06B 45/10

[58] Field of Search ..... 149/38, 93, 97, 39, 149/19.92, 19.8, 98, 76, 42, 91, 92, 104; 264/3

[56] References Cited

UNITED STATES PATENTS

| | | | |
|---|---|---|---|
| 1,867,287 | 7/1932 | Stettbacher | 149/93 |
| 2,375,175 | 5/1945 | Sile | 149/93 |
| 2,381,468 | 8/1945 | Silk | 149/93 |
| 2,440,327 | 4/1948 | Crawford | 149/97 |
| 2,759,807 | 8/1956 | Kouba | 149/93 |
| 2,877,504 | 3/1959 | Fox | 18/59 |
| 2,982,641 | 5/1961 | Dawson et al. | 149/39 |
| 2,993,822 | 7/1961 | Reeves | 18/59 |
| 3,026,221 | 3/1962 | Kirst | 149/39 |
| 3,033,716 | 5/1962 | Preckel | 149/38 |
| 3,033,717 | 5/1962 | Preckel | 149/38 |
| 3,036,939 | 5/1962 | Camp | 149/93 |
| 3,037,891 | 6/1962 | Maug | 149/97 |
| 3,041,216 | 6/1962 | Bice | 149/93 |
| 3,088,858 | 5/1963 | Camp | 149/97 |
| 3,102,834 | 9/1963 | Camp | 149/97 |

*Primary Examiner*—Stephen J. Lechert, Jr.
*Attorney, Agent, or Firm*—R. S. Sciascia; Roy Miller

EXEMPLARY CLAIM

7. A process for preparing a solid propellant composition having a plateau-burning rate comprising the steps of a. mixing at room temperature the following ingredients until a viscous binder results:

| Ingredients | Percent by weight |
|---|---|
| High energy plasticizer selected from the group consisting of pentaerythritol trinitrate, diethylene glycol dinitrate, trimethylolethane trinitrate and mixtures thereof | 15 to 85 |
| Plastisol nitrocellulose | 10 to 50 |
| Ethyl centralite | .4 to 5; |

b. blending into said binder, until a homogeneous pourable mixture result a cured propellant composition which has been milled to an average particle size of about 30 mesh, said composition consisting essentially of the following ingredients

| Ingredients | Percent by weight |
|---|---|
| Nitrocellulose | 13.5 to 27.5 |
| Nitroglycerin | 10.5 to 22.5 |
| Additives | .003 to 6 |

said additives selected from the group consisting of di-n-propyl adipate, 2-nitrodiphylamine, lead $\beta$-resorycylate, potassium sulfate, lead stearate, candellila wax and carbon black;

c. casting said mixture into a rocket motor tube; and d. curing for about 2 hours at about 180° F.

10 Claims, 3 Drawing Figures

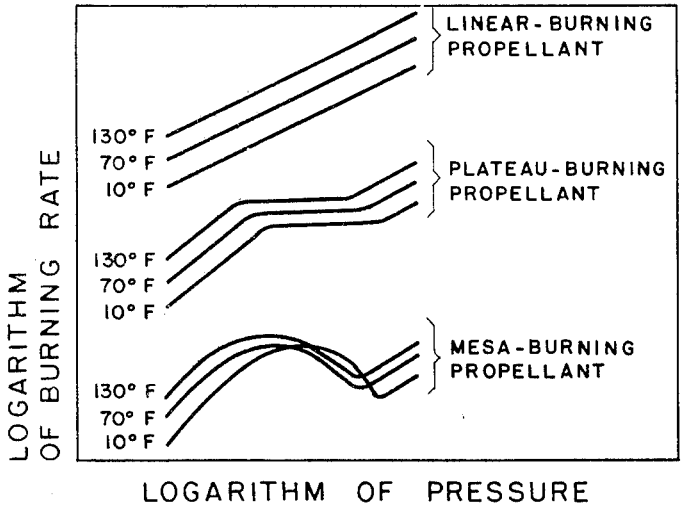
FIG. 1.
FIG. 2.
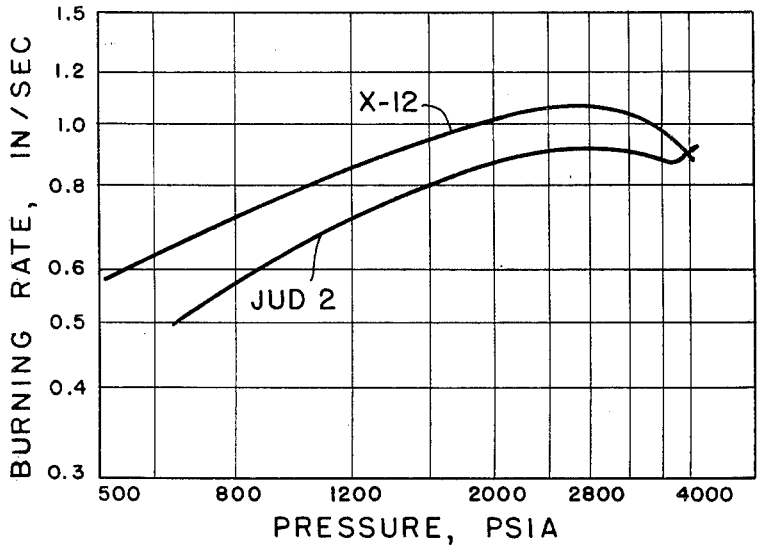
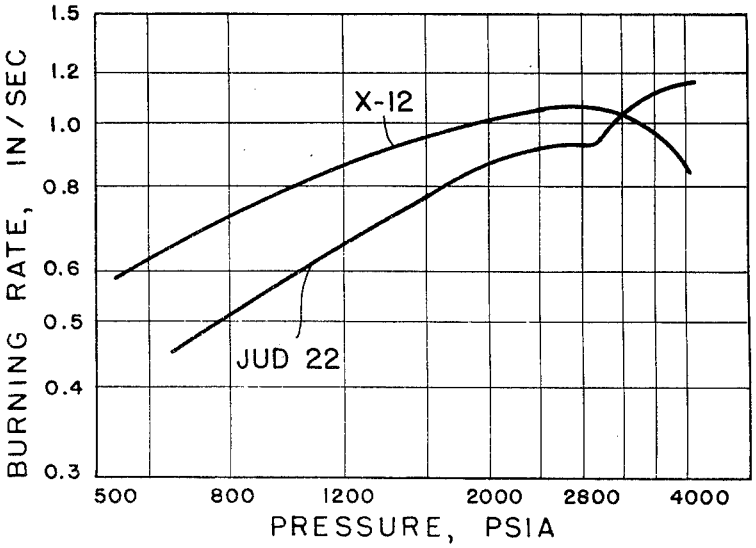
FIG. 3.
*INVENTOR.*
JUDSON B. ELDRIDGE
*BY*
P. H. Firsht
ATTORNEY.

SOLID PROPELLANT MIXTURES AND PROCESS OF PREPARATION

The invention herein described may be manufactured and used by or for the Government of the United States of America for governmental purposes without the payment of any royalties thereon or therefor.

The present invention relates to solid propellant mixtures and to the process of preparation. In one of its more specific aspects it relates to a new method of modifying the burning rate of castable nitrasol propellants and in still another aspect the invention relates to a sequence of steps employed in casting solventless double base propellants whereby controlled burning results.

The velocity at which a solid propellant is consumed during operation is called the burning rate. IT is measured in a direction normal to the propellant surface and is usually expressed in inches per second. Significant advances have been made in improving solid propellant burning-rate characteristics by modification of the composition. The general purpose of the present invention is to blend a castable plastisol binder with or without oxidizer and fuel with various double base propellant compositions thereby combining the desirable features of unlike solid propellants.

It is therefore an object of this invention to provide a method of casting a solventless double base propellant which has a controlled burning rate.

Another object of this invention is to provide a propellant mixture having an improved burning rate.

A further object of this invention is to provide a method for improving solid propellant burning characteristics.

Still another object of this invention is to provide a blend of a castable plastisol binder with or without oxidizer and fuel with a double base propellant which has the desirable features of each.

Other objects, features and many of the attendant advantages of this invention will become readily appreciated as the same become better understood by reference to the following description and graphs wherein:

FIG. 1 illustrates the typical burning-rate-pressure relationship for solid propellant;

FIG. 2 shows the strand burning-rate for a double base propellant, designated X—12, and the same propellant when blended with a nitrasol binder, designated Jud 2; and FIG. 3 shows strand burning-rate data for a double base propellant designated X-12 and for the same double base propellant when blended with a nitrasol propellant, designated Jud 22.

In work on nitrasol and double base propellants it was discovered that by using a nitrasol propellant or a nitrasol binder with a double base propellant as a loading agent plateau-burning rate characteristics could be obtained. "Nitrasol" is the name for a group of propellants developed at the U.S. Naval Ordnance Test Station, China Lake, Calif., the binders and propellants being described in patent application Ser. No. 761,448. The binder for the nitrasol propellant comprises a mixture of from about 15 to 85 percent high energy plasticizer, zero to 20 percent inert plasticizer, and about 10 to 50 percent plastisol nitrocellulose. The high energy plasticizer is one selected from the group consisting of primary and secondary nitrate esters both liquid and solid. The nitrocellulose is converted to tiny hard dense spheres (of the order of 10 microns diameter) which are then suspended at elevated temperatures in a plasticizer to form a rubbery binder. The preferred high energy plasticizers include PETriN (pentaerythritol trinitrate), DEGN (diethylene glycol dinitrate), TMETN (trimethylolethane trinitrate) or any mixture of them. The inert plasticizers are conventional and may be added to modify ballistic and physical properties. Dibutyl phthlate is commonly employed as such a plasticizer.

There are two major classes of solid propellants in current use: the double base and the composites. By definition the double base propellants have as their principal constituents, two completely independent consumable or explosive materials which are worked together to produce a colloidal mixture. These two ingredients are generally nitrocellulose and nitroglycerin. Each of these materials (and therefore, the mixture) contains both fuel and oxidizer, and the double base propellants, therefore, do not contain discrete fuel and oxidizer particles dispersed in a matrix, as do the composites.

Most of the new propellant compositions which have been developed within recent years do not possess burning-rate characteristics comparable to those of the "old-fashioned" compositions; that is, the logarithmic plot of burning-rate versus pressure no longer assumes a straight line called "linear" burning; but instead "mesa" and "plateau" burning have appeared. A plateau-burning propellant is one for which the logarithmic plot of burning-rate versus pressure deviates from that of linear in the following manner. At low pressures, the burning-rate-pressure relationship is generally linear with a moderately high pressure exponent (e.g., $n > 0.5$). This is followed by a pressure range where the burning-rate becomes nearly constant (e.g., $-0.3 > n > 0.3$). Finally, the burning-rate becomes about as sensitive to changes in pressure as it was at the low pressure (e.g., $N > 0.5$). A mesa burning propellant is one for which the logarithmic plot of burning-rate versus pressure resembles that of a plateau-burning propellant in all respects except that, in the region of low dependence of rate or pressure, the pressure exponent eventually assumes a value more negative than $-0.3$. Often the isotherms at low temperatures cross over the isotherms at higher temperatures in the region of negative pressure exponent, resulting in a truly negative coefficient. FIG. 1 is a graph illustrating the three burning-rate curves above discussed, the linear-burning rate curve being designated as A, the plateau-burning-rate as B, and the mesa-burning-rate as C.

In the present invention a selected cured double base propellant is milled through a 30 mesh screen and incorporated in an uncured nitrasol binder or propellant, forming a mixture or blend of uniform composition. Mixing is accomplished at room temperature using any suitable mixer and facilities common to most composite propellant manufacturing. The resulting mixture or blend of propellant is very thick and viscous, but still pourable. It is poured from the mixer into a transfer vessel for transportation to the casting room where it is cast in a rocket motor tube and placed in an oven to cure for about two hours at about 180° F. After curing is complete, the core is removed, if it is not an integral part of the propellant, and excess propellant cut away. Nozzle assemblies are attached and the rocket is now ready for final inspection.

The following examples illustrate the invention but are not to be construed to limit the invention.

EXAMPLE I

Nitrasol binder and double base propellant

A propellant mixture or blend was prepared from the composition set forth in Table A below using the procedure following Table A.

TABLE A

| Components | | Percent by Weight |
|---|---|---|
| Binder (Nitrasol H) | | |
| Plastisol nitrocellulose 12.6%N | | 14.2 |
| Ethyl centralite | | 0.8 |
| Pentaerythritol trinitrate | | 35.0 |
| Double base propellant (X-12) | | 50.0 |
| Nitrocellulose | 50% | |
| Nitroglycerin | 38 | |
| Di-n-propyl adipate | 5.9 | |
| 2-Nitrodiphenylamine | 2.0 | |
| Lead β-resorcylate | 2.0 | |
| Basic cypric salicylate | 2.0 | |
| Candelilla Wax | 0.1 | |

The nitrasol binder used in this invention is prepared by mixing at room temperature 45 grams of plastisol nitrocellulose, including ethyl centralite, with 105 grams of pentaerythritol trinitrate in a sigma blade mixer for about 30 minutes or until the nitrocellulose is well dispersed forming a viscous mixture; then blending into this mixture 150 grams of cured double base propellant of the composition set out in Table A, of uniform particle size, having been milled through a 30 mesh screen. The mixture or blend is now agitated for about 30 minutes under vacuum to remove entrapped air. The mixing is then discontinued and the mixture or blend cast into a rocket motor tube, in the absence of pressure or vacuum and the tube is placed in an oven at about 180° F. for from 1 to 2 hours. At the end of the period, the propellant is cured and ready for firing.

FIG. 2 is a graph comparing the strand burning-rate of the above described blended composition designated, Jud 2, which shows a plateau-burning-rate characteristic as against the mesa-burning-rate characteristic shown by the double base propellant composition alone, the composition of which is also shown in Table A, and designated Z-12.

EXAMPLE II

Another propellant mixture was prepared using the same procedure as described in Example I using the composition set forth in Table B below.

TABLE B

| Components | | Percent by Weight |
|---|---|---|
| Nitrasol Propellant | | |
| Plastisol Nitrocellulose (12.6%N) | | 7.6 |
| Ethyl centralite | | 0.4 |
| Pentaerythritol trinitrate | | 32.0 |
| Ammonium perchlorate | | 20.0 |
| Aluminum (atomized) | | 10.0 |
| Double base propellant (X-12) | | 30.0 |
| Nitrocellulose | 50% | |
| Nitroglycerin | 38 | |
| Di-n-propyl adipate | 5.9 | |
| 2-Nitrodiphenylamine | 2.0 | |
| Lead β-resorcylate | 2.0 | |
| Candelilla Wax | 0.1 | |

The nitrasol propellant is first prepared by mixing 24 grams of plastisol nitrocellulose, including ethyl centralite, in a sigma blade mixer with 96 grams of pentaerythritol trinitrate for about 30 minutes or until the nitrocellulose is well dispersed; 60 grams of ammonium perchlorate are added and mixed until wet (for about one minute); then 30 grams of atomized aluminum are added and the whole mixture agitated until the aluminum is wetted (about one minute). To this propellant mixture 90 grams of cured double base propellant of the composition set out in Table B which has been milled to 30 mesh screen are added. This mixture or blend is now agitated for about 30 minutes under vacuum as in the previously described process. All mixing is at room temperature. The mixture or blend is now cast in a rocket motor tube, cured in an oven for about 2 hours at a temperature of 180° – 185° F.

FIG. 3 is a graph of strand burning rate data showing the plateau-burning curve of the above mixture or blend designated, Jud 22, as compared to the mesa-burning curve of the double base composition shown in Table B, and designated X-12.

EXAMPLE III

A propellant mixture or blend was prepared like those preceding using the ingredients set forth in Table C below.

TABLE C

| Components | | Percent by Weight |
|---|---|---|
| Binder (Nitrasol H) | | |
| Plastisol nitrocellulose 12.6%N | | 14.2 |
| Ethyl centralite | | 0.8 |
| Pentaerythritol trinitrate | | 35.0 |
| Double base propellant (JPN) | | 50.0 |
| Nitrocellulose (13.25%N) | 51.40 | |
| Nitroglycerin | 42.90 | |
| Diethyl phthalate | 3.23 | |
| Ethyl centralite | 1.0 | |
| Potassium sulfate | 1.25 | |
| Carbon black | 0.20 | |
| Candelilla Wax | 0.02 | |

The binder composition was prepared using the same recipe and the procedure of Example I. A double base propellant having the composition set forth in Table C and designated JPN above was incorporated into the uncured binder as previously described in Example I.

The linear-burning rate of this propellant blend was decreased as compared to the double base propellant composition above. The pressure exponent remained the same at 0.70 in a range of 500 to 2,000 psi.

EXAMPLE IV

A solid propellant mixture or blend was prepared using the same procedure as hereinbefore described utilizing the ingredients shown in Table D below.

TABLE D

| Components | | Percent by Weight |
|---|---|---|
| Binder (Nitrasol H) | | |
| Plastisol nitrocellulose 12.6%N | | 14.2 |
| Ethyl centralite | | 0.8 |
| Pentaerythritol trinitrate | | 35.0 |
| Double base propellant (N-4) | | 50.0 |
| Nitrocellulose (12.6%N) | 51.0 | |
| Nitroglycerin | 34.3 | |
| Diethyl phthalate | 10.6 | |
| 2-Nitrodiphenylamine | 2.0 | |
| Lead stearate | 0.5 | |
| Potassium sulfate | 1.5 | |
| Carbon black | 0.1 | |

The binder composition was prepared in the same manner as described in Example I and a double base composition, designated N-4, having the composition set out in Table D was incorporated into the uncured binder.

The linear-burning-rate of the double base composition was decreased when mixed with the above described nitrasol binder, however, the pressure exponent of the double base was increased from 0.53 to 0.67 at a range of 500 to 2,000 psi.

Other nitrasol binder compositions which may be substituted for any of the above examples include:

| Binder (designated SR) Ingredients | Weight Percent |
|---|---|
| Plastisol nitrocellulose, 12.6%N, including 5% ethyl centralite | 22 |
| Pentaerythritol trinitrate | 64 |
| Cellulose acetate | 6 |
| Triacetin | 6 |
| Resorcinal | 2 |

| Binder (designated SJ) Ingredients | Weight Percent |
|---|---|
| Plastisol nitrocellulose, 12.6%N, including 5% ethyl centralite | 31 |
| Pentaerythritol | 53 |
| Triethylene glycol dinitrate | 10 |
| Triethyl phosphate | 4 |
| Resorcinal | 2 |

Still other nitrasol binders which were used are described in patent application Ser. No. 761,448.

In addition to modifying the burning-rate of double base propellants, the blending or mixing of a selected double base propellant with nitrasol binder, with or without oxidizer and metal fuels, produces a new mixture or blend which is castable. In other words, the mixture described in Examples I - IV is thick and viscous, but pourable; therefore, it can be cast directly into the rocket motor tube. This is apparently due to the fact that the nitrasol composition acts as a solventless binder for the double base propellant components. Generally, double base type propellants are prepared by a solvent or solventless extrusion process. In the known method of casting double base propellants, nitroglycerin liquid with additives is cast into an evacuated mold which has been preloaded with small pellets of nitrocellulose. Thereafter, the mold is heated and the nitrocellulose forms a nearly homogeneous solid with the liquid mixture. The method of this invention not only produces a modified or controlled burning-rate double base propellant but also a castable solventless double base propellant.

Obviously many modifications and variations of the present invention are possible in the light of the above teachings. It is therefore to be understood that within the scope of the appended claims the invention may be practiced otherwise than as specifically described.

What is claimed is:

1. A process for preparing a solid propellant composition having a modified burning-rate comprising the steps of providing a cured double base propellant which has been milled to a uniform mesh, mixing said propellant with an uncured nitrasol binder until a homogenous mixture results, casting said mixture and curing in an oven at about 180° F. for about 2 hours.

2. A solid propellant mixture comprising from about 50 to 70 percent by weight binder consisting essentially of plastisol nitrocellulose, ethyl centralite, and pentaerythritol trinitrate and from about 30 to 50 percent by weight cured double base propellant consisting essentially of nitrocellulose and nitroglycerin.

3. A process for producing a solid propellant composition comprising the steps of mixing about 45 grams of plastisol nitrocellulose with about 105 grams of pentaerythritol trinitrate for about 30 minutes until a viscous mixture results, blending into said mixture about 150 grams of cured double base propellant of uniform particle size for about 30 minutes whereby a pourable mixture results, casting said mixture into a rocket motor tube and curing for about 2 hours at a temperature of about 180° F.

4. A method for producing a castable solventless double base propellant having a controlled burning-rate comprising blending an uncured nitrasol binder with cured double base propellant milled to uniform particle size until a thick, viscous mixture results, casting said mixture into a rocket motor tube and curing.

5. A method for producing a castable solventless double base propellant grain comprising first preparing a nitrasol propellant composition comprising mixing 24 grams of plastisol nitrocellulose with 96 grams of pentaerythritol trinitrate for about 30 minutes, adding 60 grains of ammonium perchlorate and mixing until wet for about one minute, then adding 30 grams of aluminum and agitating for about one minute; to said nitrasol propellant composition 90 grams of cured double base propellant which has been milled to about 30 mesh particle size are now added and agitated for about 30 minutes at room temperature, until a uniform blend results, said blend is now cast into a rocket motor tube and cured for about 2 hours at 180° F.

6. A solid propellant composition comprising about 7.6 percent plastisol nitrocellulose, about 0.4 percent ethyl centralite, about 32 percent pentaerythritol trinitrate, about 20 percent ammonium perchlorate, about 10 percent aluminum and cured double base propellant composition which consists essentially of 15 percent nitrocellulose, 11.4 percent nitroglycerin, 1.77 percent di-n-propyl adipate, 0.6 percent 2-nitrodiphenylamine, 0.6 percent lead $\beta$-resorcylate and .03 percent wax.

7. A process for preparing a solid propellant composition having a plateau-burning rate comprising the steps of a. mixing at room temperature the following ingredients until a viscous binder results:

| Ingredients | Percent by weight |
|---|---|
| High energy plasticizer selected from the group consisting of pentaerythritol trinitrate, diethylene glycol dinitrate, trimethylolethane trinitrate and mixtures thereof | 15 to 85 |
| Plastisol nitrocellulose | 10 to 50 |
| Ethyl centralite | .4 to 5; |

b. blending into said binder, until a homogeneous pourable mixture result a cured propellant composition which has been milled to an average particle size of about 30 mesh, said composition consisting essentially of the following ingredients

| Ingredients | Percent by weight |
|---|---|
| Nitrocellulose | 13.5 to 27.5 |
| Nitroglycerin | 10.5 to 22.5 |

-continued

| Ingredients | Percent by weight |
|---|---|
| Additives | .003 to 6 |

said additives selected from the group consisting of di-n-propyl adipate, 2-nitrodiphylamine, lead β-resorycylate, potassium sulfate, lead stearate, candellila wax and carbon black;

c. casting said mixture into a rocket motor tube; and d. curing for about two hours at about 180° F.

8. A process for making a solid propellant composition which has a plateau-burning-rate characteristic comprising the steps of 1. preparing a viscous binder consisting essentially of a mixture of
   plastisol nitrocellulose,
   ethyl centralite and
   pentaerythritol trinitrate;
2. blending into said binder a precured double base composition milled to uniform particle size until a homogenous mixture results; and
3. curing said mixture at about 180° F. for about two hours, said double base composition consisting essentially of nitrocellulose and nitroglycerin.

9. A propellant blend consisting of the following constituents:

| Constituents: | Percent by weight |
|---|---|
| Plastisol nitrocellulose | 14.2 |
| Ethyl centralite | 0.8 |
| Pentaerythritol trinitrate | 35.0 |
| Nitrocellulose | 25.0 |
| Nitroglycerin | 19.0 |
| Di-n-propyl adipate | 2.95 |
| 2-Nitrodiphenylamine | 1.0 |
| Lead β-resorcylate | 1.0 |
| Basic cypric salicylate | 1.0 |
| Candelilla wax | .05. |

10. A propellant mixture consisting of the following constituents:

| Constituents: | Percent by weight |
|---|---|
| Plastisol nitrocellulose | 14.2 |
| Ethyl centralite | 0.8 |
| Pentaerythritol trinitrate | 35.0 |
| Nitrocellulose | 25.50 |
| Nitroglycerin | 17.15 |
| Diethyl phthalate | 5.3 |
| 2-Nitrodiphenylamine | 1.0 |
| Lead stearate | .25 |
| Potassium sulfate | .75 |
| Carbon black | .05. |

* * * * *